United States Patent [19]

Dittmer et al.

[11] Patent Number: 4,498,373

[45] Date of Patent: Feb. 12, 1985

[54] AIR INLET SYSTEM

[76] Inventors: Willard W. Dittmer, Rte. 1, Box 250A; Mark W. Dittmer, 111 E. 14th St., both of Higginsville, Mo. 64037

[21] Appl. No.: 485,746

[22] Filed: Apr. 18, 1983

[51] Int. Cl.[3] ..... F24F 7/007

[52] U.S. Cl. ..... 98/33.1; 98/119

[58] Field of Search ..... 98/33 R, 37, 39, 116, 98/118, 119, DIG. 6; 137/527.8; 236/49

[56] References Cited

U.S. PATENT DOCUMENTS

| | | | |
|---|---|---|---|
| 1,975,316 | 10/1934 | Ferris | 98/119 X |
| 2,862,434 | 12/1958 | Edwards . | |
| 3,307,469 | 3/1967 | Bohanon . | |
| 3,938,428 | 2/1976 | Van Huis | 98/33 R X |
| 3,945,398 | 3/1976 | Masheder | 137/527.8 |
| 4,171,722 | 10/1979 | Huggins | 165/95 |
| 4,184,538 | 1/1980 | Rauenhorst | 165/66 |
| 4,334,577 | 6/1982 | George | 98/119 X |

OTHER PUBLICATIONS

Cyclone International, Inc., "Self Adjusting Air Inlet", Instruction Manual #60-94-003, Aug. 18, 1975.

*Primary Examiner*—Harold Joyce

*Attorney, Agent, or Firm*—Schmidt, Johnson, Hovey & Williams

[57] ABSTRACT

In negative pressure ventilating system wherein atmospheric air is introduced along the walls of a building adjacent the roof, insulated, hinged valves provided within the associated airways rise automatically from their lower, fully closed position by the pressure of the incoming air as the inside pressure is reduced to below atmospheric. The bottoms of the valves and the surfaces upon which they rest, when closed by gravity, are contoured to reduce resistance to free air flow in the airways. A smooth, uninterrupted change of directional flow is effected by streamlining both the valves and the opposed surfaces, virtually eliminating air turbulence from the inlets to the discharge ends of the air ducts. By elimination of abrupt changes in the direction of flow the incoming air is properly controlled. The air is gradually directed along the airways downwardly and inwardly away from the ceiling and the adjacent wall such as to provide proper air distribution within the building regardless of variances in the rate of air flow. The surfaces are formed on baffling which controls air circulation within the building.

7 Claims, 3 Drawing Figures

AIR INLET SYSTEM

Our present invention relates to improvements in ventilating systems in which we provide an air inlet valve and an associated shelf complementally contoured such as to minimize resistance to air flow thereacross, thereby decreasing eddies and other turbulence such that as atmospheric air is channeled between the valve and the shelf its direction of flow is changed so gradually as to provide a smooth, well-defined, continuous path of travel.

We have found that whenever outside air is drawn into a building for ventilation purposes to control inside temperature and humidity, one or more abrupt changes in the direction the air must travel results in substantial inefficiency. Moreover, any unnecessary resistance to flow within the airway tends to create a disadvantageous vortex-like motion which runs contrary to the main current.

Hence, we provide air-foil surfaces, as above indicated, so shaped and oriented as to control direction. By streamlining the surfaces across which the air flows in the air duct, through which the air moves into the building interior, we are able to reduce resistance and virtually eliminate the swirling eddies which would otherwise occur.

A substantial portion of the bottom surface of the elongated freely-swingable valve is transversely convex, whereas the elongated underlying surface, upon which the valve rests when closed, has a rather long, transverse curvature which is concave in nature. The transition of air flow from vertical, as it enters the inlet passage, to a downward slope as the air discharges into the space being ventilated, enhances the efficiency of the ventilating system in both hot and cold weather, providing improved air distribution regardless of the rate at which the air is pulled into the building and steadily exhauted therefrom.

Figure 1:
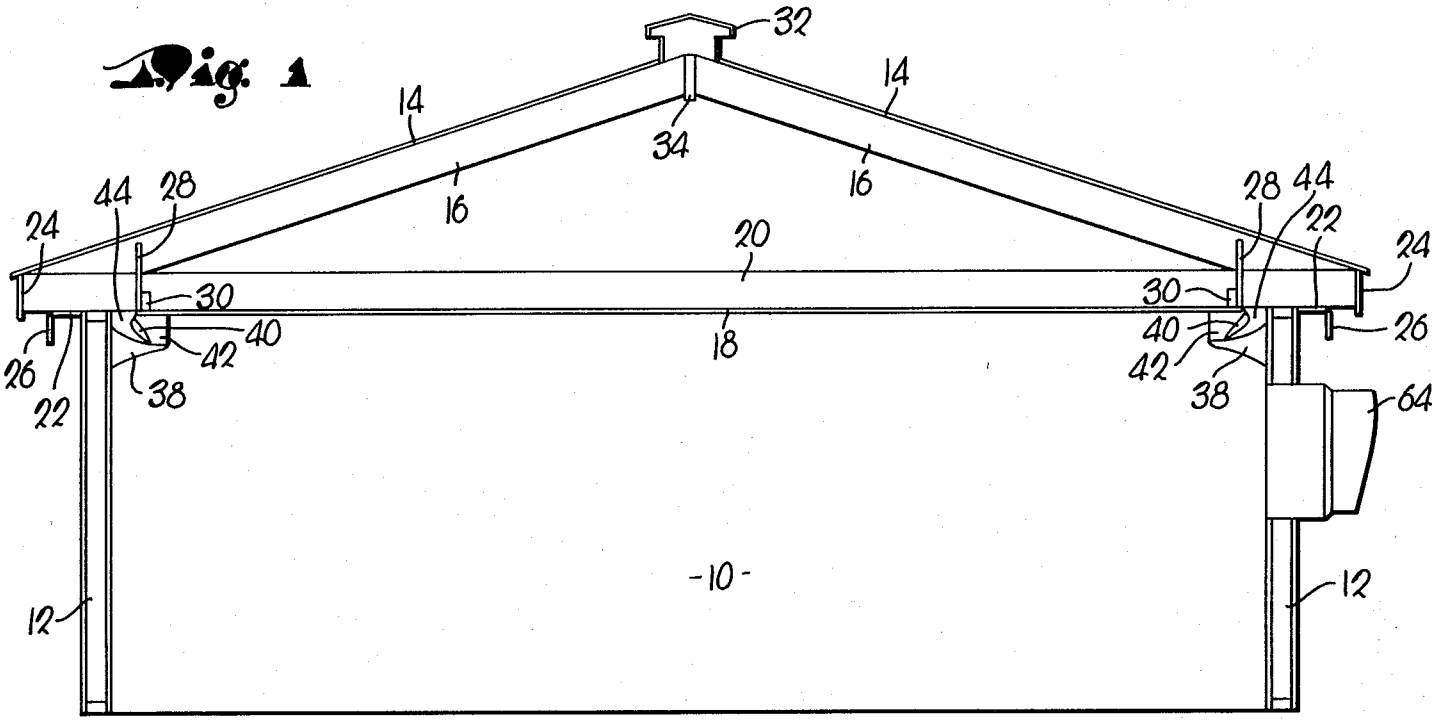
FIG. 1 is a view looking into one end of a building showing the air inlet system forming the subject matter of our present invention.
Figure 2:
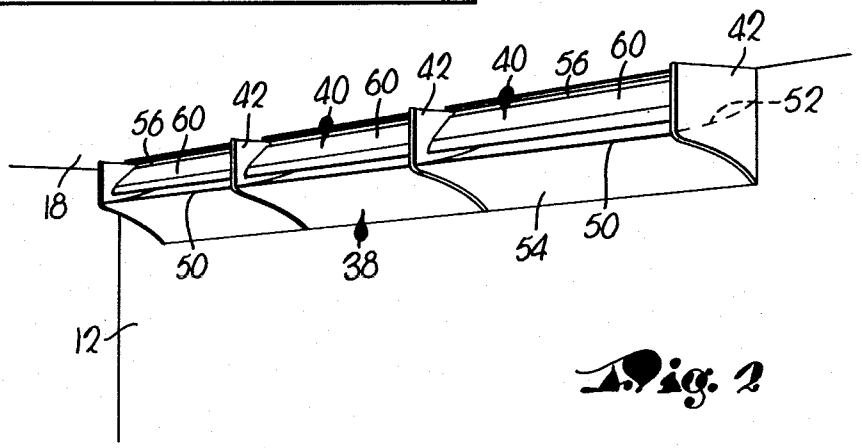
FIG. 2 is an enlarged, fragmentary, perspective view illustrating a portion of the system shown in FIG. 1 along one wall of the building.
Figure 3:
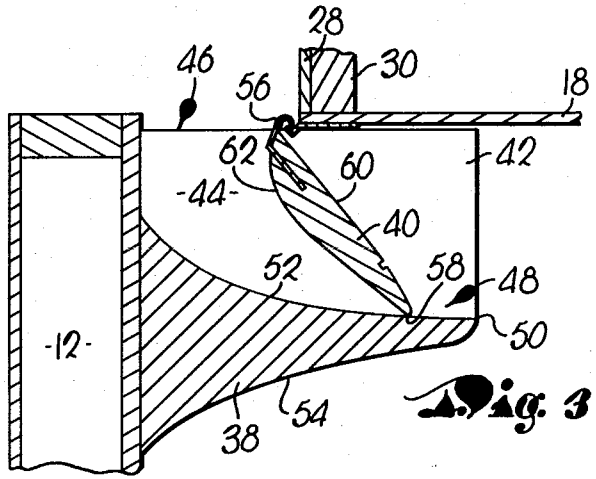
FIG. 3 is an enlarged, fragmentary, vertical cross-sectional view through the system at one of the building walls.

One type of building to be ventilated by use of the system about to be described, designated by the numeral 10, has a pair of elongated, horizontally spaced, upright side walls 12, supporting a roof 14 having rafters 16 and also supporting a ceiling 18 beneath tie beams 20. As shown, eaves are provided by projecting the roof 14, its rafters 16 and the beams 20 outwardly beyond the upper edges of the walls 12. The beams 20 are joined therebeneath, exteriorly of the building 10 by strips 22 and the outer ends of the beams are interconnected by end plates 24. Doors 26, hinged to the strips 22, shown open in FIG. 1, may be closed and latched in place to prevent entrance of air into the building 10 at the eaves under certain ambient, climatic conditions.

Upstanding panels 28 above the ceiling 18, spaced inwardly of the walls 12, and secured to cross pieces 30 between the beams 20, terminate at their upper, longitudinal edges slightly below the roof 14.

A hollow ridge row 32 on the roof 14 above a ridge pole 34 between the rafters 16 is adapted for free flow of air into and out of an attic 36 above the ceiling 18. It is contemplated that the strips 22, the plate 24, the doors 26, the panels 28, the row 32 and the pole 34 will be coextensive in length with the walls 12.

Mounted on the inner face of each wall 12 adjacent the ceiling 18, and extending throughout the lengths of the walls 12, are a number of elongated, air-deflecting baffles 38 and corresponding, elongated air valves 40, separated by upstanding partitions 42, and presenting a plurality of airways 44 above the baffles 38.

Each airway 44 has an upper, vertical air inlet 46 communicating with the proximal spaces between the beams 20, such spaces extending from the panels 28, to the plates 24. Each airway 44 is also provided with a lower air outlet 48 discharging into the building 10. The outlets 48 span the distances between the partitions 42 and extend from the ceiling 18 to innermost, longitudinal edges 50 of the baffles 38.

Each baffle 38 has an upper surface 52 transversely inclined downwardly and inwardly as its edge 50 is approached, and a lower surface 54 transversely inclined upwardly and inwardly as its edge 50 is approached, both longitudinally flat surfaces 52 and 54 being largely concave transversely thereof to provide streamlined contouring. The surfaces 52 are spaced well below the beams 20 and the ceiling 18.

The valves 40 are suspended from the ceiling 18 and/or the partitions 42 by hinges 56 at the inlets 46 and, when fully closed, their lowermost and innermost, longitudinal edges 58 rest on the surfaces 52 in spaced relationship to the outlets 48 and the edges 50. The hinges 56 are disposed adjacent and below the panels 28 and the cross pieces 30, but spaced inwardly from the upper ends of proximal walls 12, whereas the partitions 42 extend from the walls 12 inwardly beyond the inlets 46 to the edges 50.

The upper, inner faces 60 of the valves 40 may be essentially flat both longitudinally and transversely. But, as in the case of the surfaces 52 and 54, the lower, outer faces 62 of the valves 40 have streamlined contours, such faces 62 being, therefore, largely convex transversely thereof though longitudinally flat. Accordingly, the faces 60 and 62 not only converge as the hinges 56 are approached but also converge as the edges 58 are approached in a manner comparable to the convergence of the surfaces 52 and 54 toward the edges 50.

The valves 40 have their greatest thicknesses approximately midway of the hinges 56 and the edges 58, whereas the baffles 50 are thickest at the corresponding wall 12. Thus, when the valves 40 are closed, as shown, by force of gravity, the air spaces of the airways 44 progressively decrease from the inlets 46 to the edges 58.

In order to prevent or lessen the leakage of heat and moisture from the building 10 through the baffles 38 and the valves 40, and to prevent or decrease their absorption of moisture, such as condensate, we contemplate the use of polystyrene or other suitable material which also renders the valve 40 relatively light in weight.

Either or both of the walls 12 are provided with one or more fans, blowers or other air movers 64 operable as exhausters of air from the building 10 to the atmosphere. At least certain of the movers 64 may be thermostatically controlled and at least one might will have variable speed characteristics.

In the wintertime, when the fans 64 are not operating, condensation oftentimes takes place in the attic 36 as warm air meets cold air. Such condensate should not be absorbed by the valves 40, rendering them useless.

OPERATION

While the doors 26 remain open in summer, during the wintertime with inclement weather conditions which are cold and/or windy, dictating the desirability of closing the doors 26, it is still possible to control the temperature and humidity within the building 10 by energizing one or more of the fans 64. The air pressure in the building 10 will drop below atmospheric as the fan or fans 64 draw outside air into the attic 36 from row 32 for flow along the rafters 16 and along the beams 20 atop the ceiling 18 for discharge from the attic 36 between the roof 14 and the upper edges of the panels 28.

The negative pressure within the building 10 will cause opening of the valves 40 by virtue of their swinging upwardly and inwardly about the horizontal axes of the hinges 56, causing the edges 58 to disengage the surface 52 as the faces 60 move toward the ceiling 18.

Air flows from the attic 36 downwardly into the airways 44 vertically from the inlets 46. As the air flows along the surface 52 and the faces 62, its direction of movement is gradually and smoothly changed from vertical to an inclined path downwardly and inwardly into the building 10 along the surfaces 52, past the opened valves 40 and through the outlets 48.

The frictional resistance to air movement through the airways 44 is minimized because of the streamlined air foils presented by the concave surfaces 52 and the convex faces 62. Thus there is virtually no air turbulence in the airways 44. The air particles follow well-defined, unobstructed, continuous paths along the airways 44 in absence of swirling eddies and resultant vortex-like motion of the air running contrary to the main currents from the inlets 46 through the outlets 48. We have provided a total absence of baffling or other structure interposed within the path of air movement along the airways 44 to change the course or direction of air flow. Abrupt changes in direction are entirely eliminated from the moment the air enters the inlets 46 until it is discharged though the outlets 48. The valves 40 rise easily and gently and to such extent as required for free flow from the attic 36, into the building 10 and thence back to the atmosphere past the fan or fans 64 placed in operation.

The air currents entering from opposite directions along the ceiling 18 tend to meet at the centerline (directly below the ridge pole 34) and thereupon descend toward the bottom of the building 10. They thereupon tend to flow outwardly in opposite directions along the bottom of the building 10 and thence upwardly along the inner faces of the walls 12, coming into contact with the surfaces 54. Those surfaces 54, extending the length of the building 10, by virtue of their configuration, smoothly and uniformly direct the air streams inwardly where they mix with the incoming air emanating from the outlets 48. The air circulation and ventilation within the building 10 as thus provided solves the problems heretofore encountered and renders our system fully effective under essentially all weather conditions.

When the outside weather is more favorable, the doors 26 are opened, causing the air to enter along the eaves and past the overhanging beams 20 for flow immediately into the airways 44 via the inlets 44, the operation then being much the same as above described. In wintertime artificial heating within the building and/or automatic control of the fans 64, if desired, will not alter the operation or have any deleterious effects insofar as proper ventilation is concerned.

The partitions 42 have several useful functions. During winter ventilating conditions air flow rates are normally low. The result is that the valves 40 are opened only slightly, causing a loss of control of the air flow. To overcome this; through use of any suitable attachments of the valves 40 to the partitions 42, we are able to fix down one or more valves 40 to increase the cfm through the other valves 40. The partitions 42 serve to prevent a "bleed over" from the adjacent valve 40 and airway 44. Also, some buildings to be ventilated are not level. To facilitate waste disposal some buildings are built on a slope. The valves 40 then would then have a tendency to work their way down the building 10. Releasable attachments of the valves 40 to the partitions 42 serve to prevent this.

Particular consideration should be given to the air foil shapes as they help reduce and possibly eliminate any instability found in the prior art. In those systems which have flat surfaces the valves will pulsate and bounce causing a disturbance in the air flow which we find very detrimental to the proper flow of air. To give a smooth, steady and more controlable air flow is the end result of our novel shapes.

It is also important to note the contemplated use of insulation in the walls 12 and the attic 36 because the building 10 will not operate properly without it. In that regard, the panels 28 serve as stops to prevent attic insulation from falling into the airways 44. Also, we contemplate the use of vapor barriers on the ventilated sides of the ceiling 18 and the walls 12 to prevent moisture migration into the insulation.

We claim:

1. In a ventilating system for controlling the humidity and temperature of air within a building having at least one air mover operable as an exhauster of air from the building to the atmosphere, the improvement of which comprises structure for automatically permitting air to flow from the atmosphere into the building when the air pressure therein drops below atmospheric upon actuation of said air mover, said structure including:

means including an elongated, inclined upwardly facing surface, presenting an airway above said surface having an upper air inlet communicating with the atmosphere and a lower air outlet discharging into the building;

an elongated, inclined air valve above said surface having a lowermost, longitudinal terminus normally resting on said surface under the influence of gravity in closed relationship to said airway; and means at the uppermost extremity of the valve supporting the same for swinging movement about an essentially horizontal axis away from said surface to a position opening the airway in response to operation of said air mover, said surface and the bottom face of the valve proximal to said surface having streamlined contours across which the air flows along the airway for reducing resistance to said flow, decreasing turbulence of the air within the airway and funneling the air along a well-defined continuous path from said inlet through said outlet, at least a portion of the contour of said surface being transversely concave and at least a portion of the contour of said face of the valve being transversely convex, said concave and convex portions extending downwardly and inwardly from the air inlet toward the air outlet.

2. The invention of claim 1, said surface extending downwardly and inwardly into said building beyond the valve when said terminus is resting on said surface with said surface terminating in an innermost longitudinal edge.

3. The invention of claim 1, said concave portion being spaced below the air inlet.

4. The invention of claim 3, said convex portion commencing substantially adjacent the air inlet at an elevation higher than said concave portion.

5. The invention of claim 1, said airway being vertically oriented at the inlet and progressively sloping arcuately downwardly and inwardly into the building as the outlet is approached.

6. The invention of claim 1, said valve processively decreasing in thickness in opposite directions toward a relatively thin longitudinal edge at said terminus and a relatively thin longitudinal edge at said uppermost extremity.

7. The invention of claim 1; and means in the building associated with said valving for deflecting air rising in the building in an inward direction for admixture with the incoming air, said deflecting means comprising an elongated baffle extending along and below the inlet means and the valving, said baffle having a lower surface transversely inclined upwardly and inwardly, said surface being at least in part transversely concave, said surfaces merging in an elongated edge at the air outlet.

* * * * *